United States Patent [19]

Wilcox et al.

[11] 4,340,139

[45] Jul. 20, 1982

[54] BLOW MOLDED CARRYING CASE

[75] Inventors: Donald G. Wilcox, Seymour; Nobile Zambrano, Branford, both of Conn.

[73] Assignee: Show-Pak, Incorporated, New Haven, Conn.

[21] Appl. No.: 236,049

[22] Filed: Feb. 19, 1981

[51] Int. Cl.[3] ..... B65D 51/04; B65D 25/18; B65D 71/00

[52] U.S. Cl. ..... 206/349; 190/51; 190/57; 220/94 R; 220/469

[58] Field of Search ..... 206/315, 349; 190/57, 190/51; 220/94, 469

[56] References Cited

U.S. PATENT DOCUMENTS

| | | | |
|---|---|---|---|
| 3,327,841 | 6/1967 | Schurman et al. | 206/349 |
| 3,339,781 | 9/1967 | Schurman et al. | 190/51 |
| 4,005,800 | 2/1977 | Schurman | 220/469 |
| 4,164,309 | 8/1979 | Staats | 190/57 |
| 4,216,862 | 8/1980 | Daenen | 220/94 |

*Primary Examiner*—William T. Dixson, Jr.
*Attorney, Agent, or Firm*—John A. Mitchell; Pasquale A. Razzano

[57] ABSTRACT

A blow molded carrying case comprises a base and a cover, each of which is formed of double walled blow molded construction. The top wall of the base extends along the rear wall and has an opening formed therein along the front wall, whereby access is provided to the interior of the base below the top wall, which in turn defines a shelf in the base. The cover has side walls which are generally complementary in plan to the side walls of the base. The cover and base have first cooperating means which define an interrupted hinge for pivotally connecting the cover to the base and second cooperating means for latching the cover to the base in a closed position.

10 Claims, 3 Drawing Figures

BLOW MOLDED CARRYING CASE

The present invention relates to carrying cases, and more in particular, to blow molded carrying cases.

For a variety of different types of products, cases must be provided for transporting the product and for storing the product. Often, the case itself may be a central part of the product as it is marketed. For example, many different types of toys having multiple pieces, are sold in high quality cases to enable children to conveniently store the pieces in a neat and secure manner. At the same time, the case must be quite durable and sturdy, to withstand rough usage.

It is an object of the present invention to provide a carrying case which is inexpensive to manufacture and durable in use.

A further object of the present invention is to provide a carrying case which can be manufactured by blow molding, and which is durable in use.

A further object of the present invention is to provide a blow molded carrying case which is readily assembled.

Yet another object of the present invention is to provide a lightweight carrying case which is durable in construction.

In accordance with an aspect of the present invention, a carrying case is provided which includes a base and a cover. The base is formed of a one-piece double wall blow molded construction wherein the base is hollow, has upper and lower walls and peripheral side walls extending therebetween. The upper wall of the base has a flat peripheral portion adjacent the side walls and inclined surface portions extending upwardly therefrom to a relatively flat top surface extending between the inclined surface portions. This flat top surface has an opening formed therein adjacent the front wall of the base to provide access into the interior of the base while defining adjacent the rear wall a rear shelf in the base. This rear shelf has recessed wells formed therein for storing diverse objects, such as, for example, toy building blocks or the like.

The cover of the carrying case is also hollow and formed of a one-piece double wall blow molded construction defining upper and lower walls and peripheral side walls therebetween. The lower wall of the cover has a flat peripheral surface which is generally complementary to the flat peripheral surface of the base and includes inclined surface portions inwardly of the flat peripheral surface which are complementary to the inclined surface portions of the base so that the base and cover mate to cooperate and resist relative lateral movement therebetween. The cover and base also include first cooperating elements defining an interrupted hinge along the rear wall of the base for pivotally connecting the cover to the base and second cooperating elements for latching the cover to the base in a closed position.

The above, and other objects, features and advantages of this invention will be apparent in the following detailed description of an illustrative embodiment thereof, which is to be read in connection with the accompanying drawings, wherein.

Figure 1:
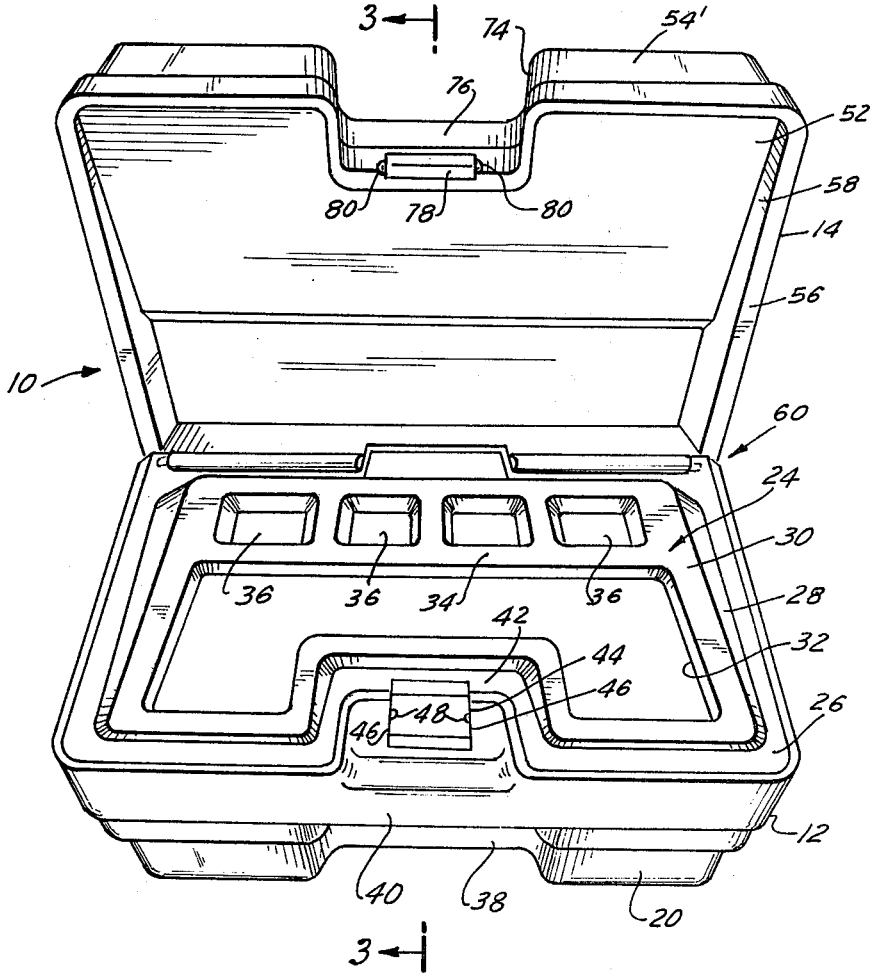
FIG. 1 is a perspective view of a carrying case constructed in accordance with the present invention.
Figure 2:
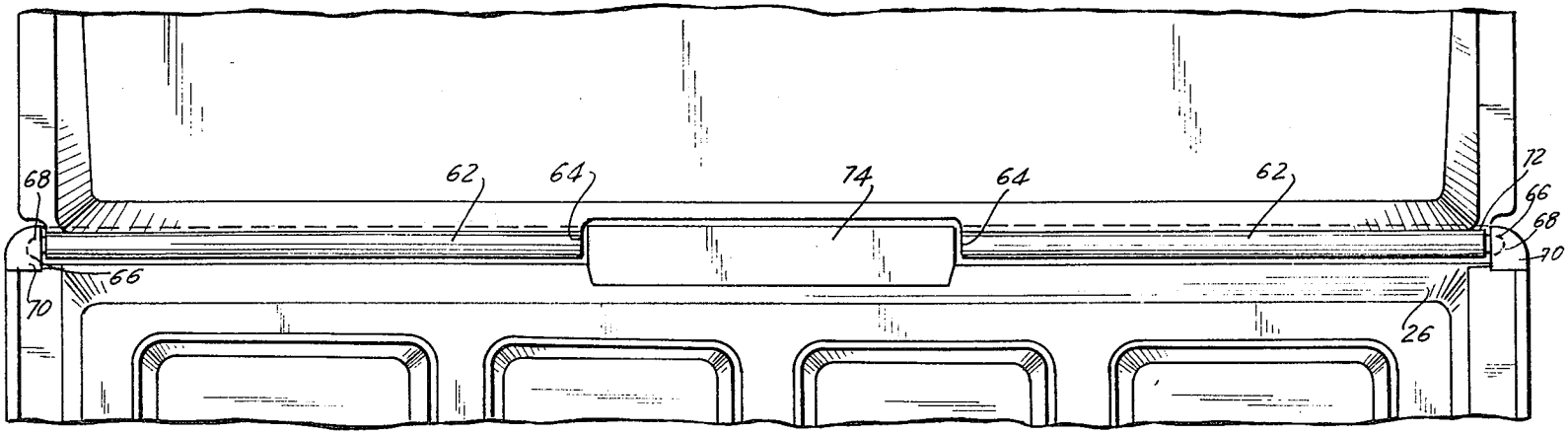
FIG. 2 is a plan view of the hinge connection between the base and cover with the cover in its fully opened position.
Figure 3:
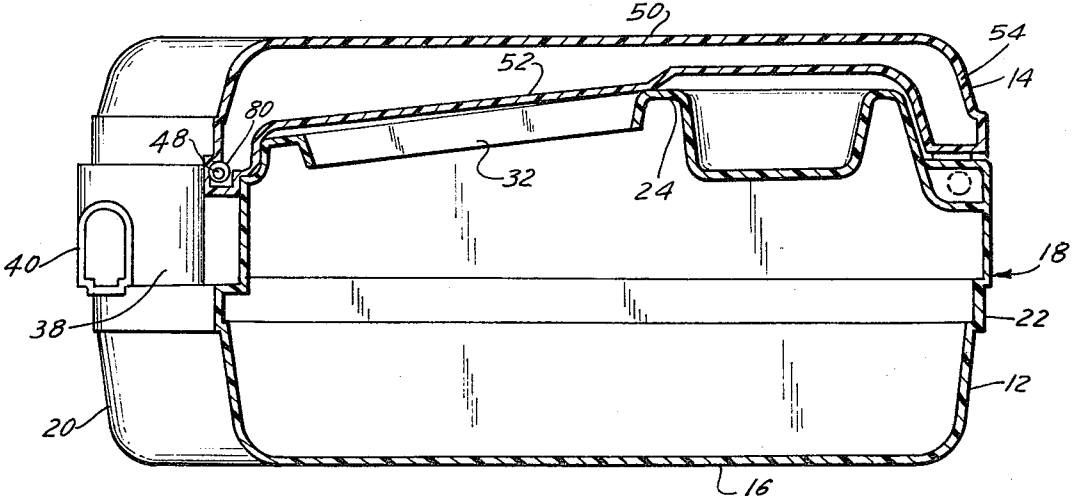
FIG. 3 is a side sectional view of the carrying case in its closed position, taken along line 3—3 of FIG. 1.

Referring now to the drawings in detail, and initially to FIG. 1 thereof, carrying case 10, constructed in accordance with the present invention includes base 12 and cover 14. Both the case and cover are formed using conventional blow molding techniques to create hollow double walled elements, as seen in FIG. 3. Base 12 is formed to have a bottom wall 16, peripheral side walls 18, including front and rear walls 20, 22 and a top wall 24. The mold used to form base 12 provides the base with the particular configuration illustrated in the drawing. In the preferred embodiment of the invention, top wall 24 is formed to provide a flat generally horizontal peripheral surface portion 26 along the side walls of the base. In addition, the top wall includes upwardly extending and inwardly inclined surfaces 28 adjacent the flat peripheral wall portion 26 inwardly of the side walls. These inclined surfaces terminate in top surface 30, which extends therebetween. Top surface 30 has an opening 32 which is cut therein, in any convenient manner, after the base is blow molded. That is, when the base is initially blow molded the area defined by opening 32 illustrated in FIGS. 1 and 3 is closed by an integral portion of the base, which is removed after the molding operation is completed. This opening provides access to the interior of the base. It also serves to cooperate with top surface 30 to define a rear shelf 34 in base 12. This rear shelf has a plurality of recessed wells 36 formed therein, in which diverse objects such as toy building blocks may be placed.

Front wall 20 of base 12 includes a central recess 38 formed therein. An integral handle 40 extends across recess 38 to permit convenient carrying of the entire case.

Recess 38 includes a rear wall portion 42 which in turn has a small rectangular recess 44 formed therein. This recess includes side walls 46 into which dimples or studs 48 project. These projections serve to cooperate with similar projections on cover 14, as described hereinafter, to latch the cover in place on the base.

As mentioned, cover 14 is also formed of a blow molded double walled construction. This construction provides the cover with an upper wall 50 and a lower wall 52, as well as peripheral side walls 54. Lower wall 52 is formed in the molding process to have a flat peripheral edge portion 56 which is generally complementary to flat surface portions 26 of base 12. In addition, surface 52 includes inwardly inclined surface portions 58 which are complementary to inclined surface portions 28 of base 12. By this construction, when the cover is placed in its closed position on the base, surfaces 28, 58, cooperate and interfere with each other, to prevent shifting of the cover on the base.

Cover 14 is pivotally connected to base 12 by an integral hinge arrangement 60 including cooperating means formed on the cover and the base. Hinge means 60 include a pair of generally cylindrical hinge elements 62 integrally formed on cover 14. These hinge elements may be formed of solid plastic in the blow molding construction. The hinge elements include oppositely facing ends 64 which are spaced from each other. Their opposite ends 66 have hinge projections formed thereon. These hinge projections are received in pockets 68 formed in abutments 70 at the ends of the rear wall of base 12. Upper flat surface portion 26 of base 12 along the rear wall of the base includes an arcuately recessed surface portion 72 which receives hinge bars 62. In addition, this surface portion includes an abutment or boss 74 formed therein that is received between ends 64 of pivot bars 62. This arrangement provides a split hinge construction connecting the cover to the base. Abutment 74 serves to reinforce the hinge connection and prevents lateral shifting of the cover with respect to the base.

Forward wall 54' of cover 14 has a recess 74 formed therein which is generally complementary to recess 38 of base 12. This recess includes a wall portion 76 on which a boss 78 is integrally formed. This boss has a pair of oppositely extending projections 80 on the ends thereof which are located to mesh and overlap with projections 48 in recess 44 of base 12. As seen in FIG. 3, projections 80, in the closed position of the cover, override projections 48, to form an interfering latch arrangement which holds the cover in its closed position. By this construction, including the combination of interfering projections 80, 48 and interfering surfaces 28, 58, cover 14 is securely held in its closed position against base 12, while the base can be transported simply by grasping handle 40.

By this construction, it is seen that a relatively simply manufactured blow molded carrying case is provided which will be durable in construction. The case can be attractively molded and include an integral shelf element formed in the blow molding operation for the base. The carrying case will be light in weight and suitable for use by a child to transport toy objects or the like.

Although an illustrative embodiment of the invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. A carrying case comprising a base and a cover for the base, said base being formed of one-piece blow molded construction including a bottom wall, peripheral side walls extending therefrom and a top wall, said top wall extending along one of said side walls to define the rear wall of the case and having an opening formed thereon along the opposite wall whereby access is provided to the interior of said base below the top wall, said cover being blow molded and having side walls generally complementary in plan to the side walls of said base, said cover and base having first cooperating means defining an interrupted hinge for pivotally connecting said cover to said base and second cooperating means for latching said cover to the base in a closed position; said base having an upwardly extending inwardly inclined surface formed adjacent said side walls and inwardly therefrom said cover having a complementary inclined surface formed therein, said inclined surface mating with each other in said closed position to form an interference fit which resists lateral movement of said base and cover with respect to each other.

2. A carrying case as defined in claim 1 wherein said cooperating means defining said interrupted hinge comprises a pair of recessed bases formed at opposite ends of said rear wall of the base and an intermediate boss therebetween, and a pair of cylindrical hinge elements formed on said cover and laterally spaced apart to receive said intermediate boss therebetween said hinge elements having outer ends including pivot pins thereon received in said recessed bosses, thereby to form a pivotal connection between said cover and base.

3. A carrying case as defined in any one of claims 1 or 3 wherein said second cooperating means comprises a pair of cooperating interference projections formed on said cover and base.

4. A carrying case as defined in claim 3 wherein said base has a recess formed in its front wall, opposite said rear wall and an integral handle blow molded thereon extending across said recess, said interference projections on said base being located within said recess.

5. A carrying case as defined in claim 1 wherein said top wall defines a shelf in said base and has recessed wells formed therein.

6. A carrying case as defined in claim 1 wherein said cover is a hollow double wall member.

7. A carrying case comprising a base and a cover, said base being formed of a one-piece double wall blow molded construction wherein said base is hollow, has upper and lower walls and peripheral side walls, including opposite front and rear walls, extending between said upper and lower walls, said upper wall having a flat peripheral portion adjacent said side walls, inclined surface portions extending upwardly from said flat peripheral portion and a top surface extending between said inclined surface portions, said top surface having an opening formed therein adjacent said front wall therein providing access to the interior of said base and defining adjacent said rear wall a rear shelf, said rear shelf having recessed wells formed therein for storing diverse objects; said cover being hollow and formed of a one-piece double wall blow molded construction to define upper and lower walls and peripheral walls therebetween, said lower wall of the cover having a flat peripheral surface which is generally complementary to the flat peripheral surface of said base and inclined surface portions inwardly of said flat peripheral surface and complementary to the inclined surface portions of the base whereby the base and cover mate and cooperate to resist relative lateral movement; said cover and base having first cooperating means defining an interrupted hinge for pivotally connecting said cover to said base and second cooperating means for latching said cover to the base in a closed position.

8. A carrying case as defined in claim 7 wherein said cooperating means defining said interrupted hinge comprises a pair of recessed bases formed at opposite ends of said rear wall of the base and an intermediate boss therebetween, and a pair of cylindrical hinge elements formed on said cover and laterally spaced apart to receive said intermediate boss therebetween, said hinge elements having outer ends including pivot pins thereon received in said recessed bosses, thereby to form a pivotal connection between said cover and base.

9. A carrying case as defined in any one of claims 1, or 8 wherein said second cooperating means comprises a pair of cooperating interference projections formed on said cover and base.

10. A carrying case as defined in claim 8 wherein said base has a recess formed in its front wall, opposite said rear wall and an integral handle blow molded thereon extending across said recess, said interference projections on said base being located within said recess.

* * * * *